United States Patent [19]

Kudija

[11] Patent Number: 4,836,185

[45] Date of Patent: Jun. 6, 1989

[54] FIREPLACE NEWSPAPER HOLDER

[76] Inventor: David A. Kudija, 1348 Beech Hill Ave., Hacienda Heights, Calif. 91745

[21] Appl. No.: 194,332

[22] Filed: May 16, 1988

[51] Int. Cl.[4] ..... F23H 13/00

[52] U.S. Cl. ..... 126/540; 126/152 B; D23/398

[58] Field of Search ..... 126/152 R, 152 A, 152 B, 126/164, 165, 298, 9 R, 9 A, 337 R, 336, 25 R, 163 R, 540, 541; 211/42, 49.1, 50, 120; D23/397, 398, 407

[56] References Cited

U.S. PATENT DOCUMENTS

| | | | |
|---|---|---|---|
| 3,785,360 | 1/1974 | Martin | 126/9 R |
| 3,838,679 | 10/1974 | Welch | 126/165 |
| 4,161,168 | 7/1979 | Cagle | 126/164 |
| 4,305,375 | 12/1981 | George | 126/164 |

*Primary Examiner*—James C. Yeung

*Attorney, Agent, or Firm*—Harlan P. Huebner

[57] ABSTRACT

A newspaper holder for use in a fireplace to receive folded newspapers in a vertical position to promote controlled combustion for warmth and visual effect when ignited wherein there is a metallic base and a plurality of spacer means raising vertically from the base forming spaces therebetween to receive pluralities of said folded newspapers for igniting and burning.

6 Claims, 1 Drawing Sheet

FIREPLACE NEWSPAPER HOLDER

BACKGROUND OF THE INVENTION

1. Field of the Invention

This invention relates to a fireplace newspaper holder wherein the newspaper placed therein may be ignited and burned for warmth and esthetic appearance within the fireplace.

2. Description of the Prior Art

Heretofore, wood or pressed paper logs have been the only thing that was burned in fireplaces for warmth and esthetic appearance.

Where newspapers has been crumpled up and ignited, the newspaper will burn too fast and not offer concentrated heat. The reason for this is the fact that too many surfaces or parts of the newspaper are in indirect contact with the oxygen in air which of course increases the combustion rate.

In some instances in the past newspapers have been rolled up to stimulate logs. However, because they cannot be tightly rolled or tightly maintained they suffer the same faith as crumbled newspaper discussed above.

Finally, if newspapers are laid flat one on top of the other there is relatively little combustion being limited to the marginal edges where there is sufficient oxygen to burn. However, again such burning is uneven and is not sufficient to create warmth or esthetics appearance within a fireplace. In addition, such flat newspapers tend to go out as well as give off excessive smoke.

SUMMARY OF THE INVENTION

It is a purpose of the present invention to provide a newspaper holder for positioning in a fireplace that will hold newspaper in such a vertical position to burn evenly and give off heat.

Another object of the present invention is to provide a newspaper holder wherein spacer means are inserted so that a plurality of newspapers when folded may be positioned vertically within the spaces created between the spacer means.

A further object of the present invention is to provide a newspaper holder with spacer means that may vary in spaced dimensions to accommodate a different amount of vertically arranged newspapers.

A still further object of the present invention is to provide a newspaper holder of such construction that oxygen may contact the newspapers encouraging an even burning as well as a relatively clean burning with little residue.

Yet another object of the present invention is to provide a newspaper holder for burning newspaper that is lightweight and easy to manufacture and assemble.

These and other objects and advantages will become apparent from the following part of the specification wherein details have been described for the competence of disclosure, without intending to limit the scope of the invention which is setforth in the appended claims.

BRIEF DESCRIPTION OF THE DRAWINGS

These advantages may be more clearly understood from the following details description and by reference to the drawings in which.

DETAILED DESCRIPTION OF THE PREFERRED EMBODIMENT

Figure 1:
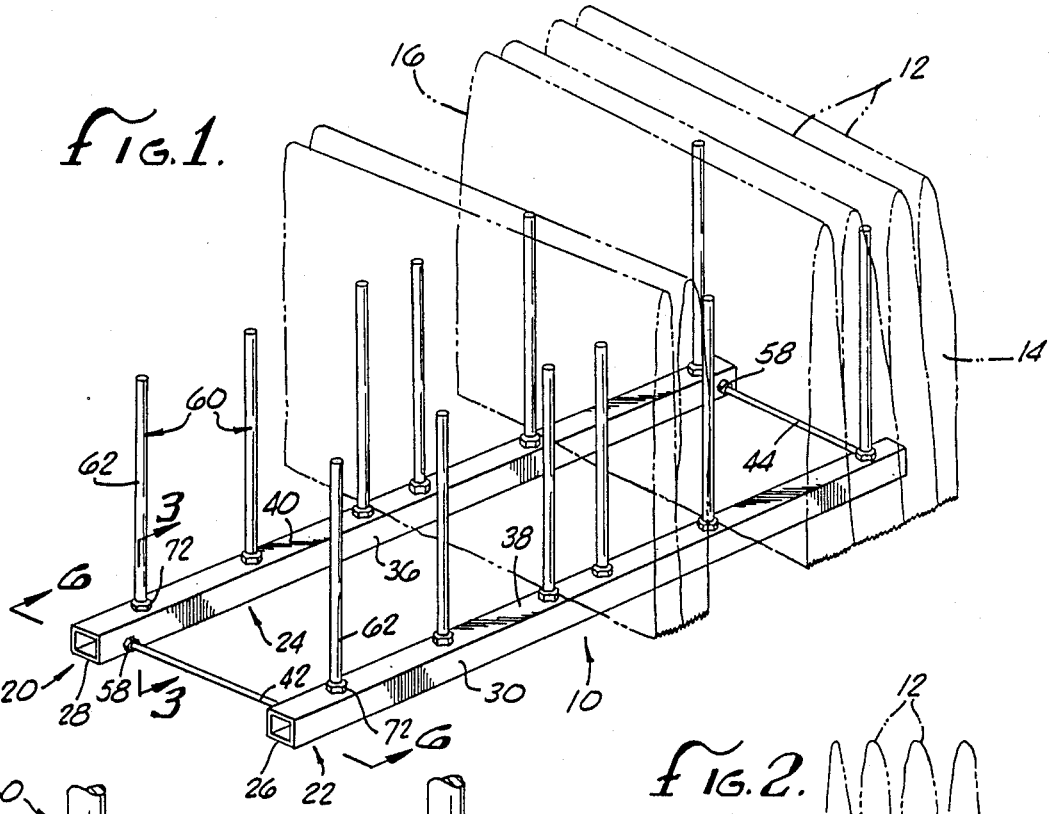
FIG. 1 is a perspective view of a newspaper holder of the present invention.
Figure 2:
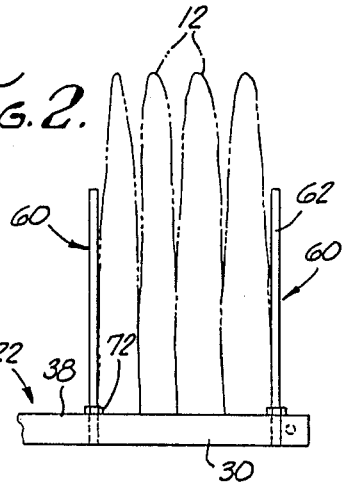
FIG. 2 is a front elevational view of a portion of the holder with newspaper in phantom mounted in the holder.

In FIG. 1 there is a illustrated a newspaper holder or newspaper rack generally designated 10. The holder 10 is adapted to be placed on the floor (not shown) of a conventional fireplace (not shown).

The purpose of the holder 10 is to retain newspapers 12, shown in phantom, in up right positions for burning to provide heat as well as the esthetics of a fire within a fireplace.

Figure 6:
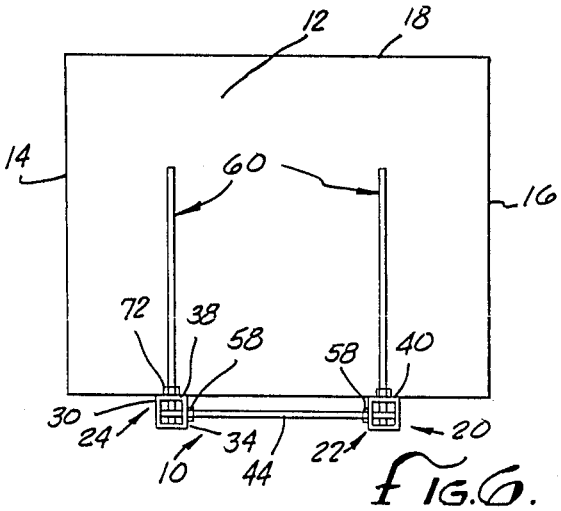
FIG. 6 is an end view of the newspaper holder with newspaper mounted therein.

The newspapers 12 as can be seen are preferably several sheets of discarded newspapers that are folded as usual along a margin 14 as well as then being folded in half from margin 14 to margin 16, see FIG. 6.

It is also preferred, but not necessary, that the fold 18 be at the top when placed in the holder 10.

The holder or rack 10 includes a base generally designated 20. The base 20 is adapted to sit on a fireplace floor.

In order to form one type of base 20 there are a pair of elongated spaced apart metallic channel members 22 and 24. The members 22 and 24 preferably are square and each have a bottom face 26, 28, a front face 30, 32, rear or interior face 34, 36 generally parallel with faces 26 and 28 and a top face 38, 40 generally parallel with bottom faces 26 and 28 respectfully. The length of the metallic channel members 22 and 24 may vary depending upon the width of the fireplace where the holder 10 is to be used.

In order to maintain the members 22 and 24 in spaced relation a pair of horizontal metallic spacer rods or cross bars 42 and 44 are provided. The rods 42 and 44 may each be provided with threaded ends 46 best seen in FIG. 3.

In the case of the rod threaded ends 46, they are each threaded into opening 48 formed through interior faces 34 and 36 respectively so that the ends 54 of the rods 42 butt against the interior surface 56. In order to maintain the rods 42 and 44 in position as shown in FIG. 1, lock nuts 58 may be cinched against interior faces 34, 36 on threads 46. Thus there is formed a flat base 20.

In order to maintain the newspapers 12 in a vertical position as shown there are a plurality of upright spacer means 60 along the base 20. Between each spacer means 60 there is a space to receive a number of folded newspapers 12 for burning.

Figure 3:
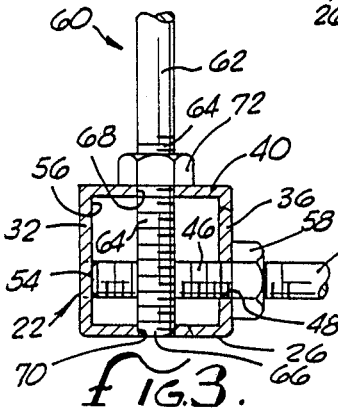
FIG. 3 is a cross sectional view taken on line 3—3 of FIG. 1.

The upright spacer means 60 are preferably a number of rods 62 that may include threaded portions 64; see FIG. 3 adjacent bottom ends 66. The rods 62 may be inserted in the metallic members 22 and 24 by being threaded into openings 68 extending through the top face 38 either where the end 66 extends to the bottom face 26 or through a threaded opening 70 therein.

To assure a locking of the upright rods 62 lock nuts 72 may be applied on the threaded portion 64 against the top faces 38, 40.

With regard to the positioning of the rods 62 along the members 22 and 24 they may be at random as illustrated in FIG. 1 or they may be equadistant one from the other. It should be noted that the dimension of the space between the rods of the same member 22 or 24 will vary the amount of newspapers that can be comfortably accommodated for burning. In other words if only a fire for a short duration is desired then a smaller space between the rods 62 may be used.

With regard to the spacer means 60 the height of the rods 62 is preferably more than half of the height of the folded newspapers 12 when in a vertical position. It has been found that a height of about two-thirds the height of the newspaper is satisfactory. In this way the newspapers will not bend over during burning but will remain upright. However, the height of the spacer means is not critical just so long as the folded newspaper is not allowed to bend over during burning.

As can be seen from the drawings the amount of folded newspapers 12 will depend upon the space between the rods. It has been found that it is not desirable to over pack the amount of folded newspapers 12 within the space. With too many such folded newspapers there would be oxygen starvation to the individual pages of the folded newspapers creating a smoldering combustible mass with little heat and no eye appeal. However, with experimentation a relatively loosely packed space will allow oxygen to restrictively enter between the folds creating a burning that will produce the desired warmth and visual effect when ignited.

Figure 5:
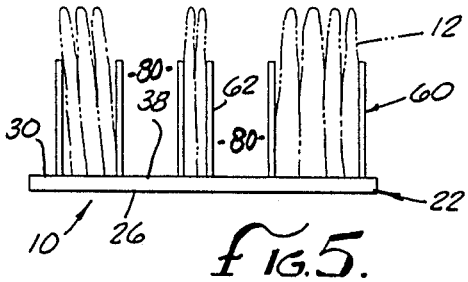
FIG. 5 is a front elevational view of an entire holder with newspaper shown in phantom mounted therein.

Further, by spacing the clusters of newspaper 12 between pairs of vertical rods 62 there can be created an open space or spaces 80 between the clusters as best illustrated in FIG. 5. These spaces 80 will act as chimneys because the air within the space 80 becomes very hot with the burning of the papers 12 which will rise which in turn will be replaced by drawing oxygen into the space or spaces 80 around the newspapers 12 and further encourage burning.

In addition, it has been found that with the folded newspapers 12 in the folded position with the edges engaging the base 20 and margins projecting beyond the upright rods 62 the newspaper will burn to a more complete consumption leaving extremely little ash or residue to be removed.

Figure 4:
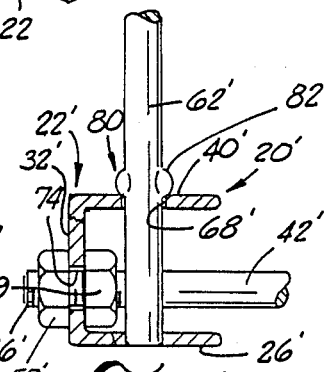
FIG. 4 is a cross-sectional view of a modification of the structure as shown in FIG. 3.

In FIG. 4 there is illustrated a modified base 20′ wherein a metallic channel member 22′ does not include an inner face but is "U" shaped. In addition, the openings 74 and 68′ in faces 32′ and 40′ may be larger than the rod 42′ and vertical rods 62′. With such construction a lock nut 58′ may be threaded on the threaded end 46′ of the cross bar rod 42′ on the exterior and an interior lock nut 59 may be threaded on the threaded end 46′ on the interior against face 32′ to retain the cross bar in place.

With regard to the vertical rods 62′ the opening 68′ will allow the rod to slide into the channel member 22′ where the bottom may be seated in the bottom face 26′. In order to prevent the vertical rods 62′ from sliding through a metal stop means 80 may be formed on the rod 62′. The stop means 80 may be one or more deformed upsets 82 that project beyond the perimeter of the rods 62′. The upsets 82 may be formed by deforming the rods 62′ in that area or affixing material of the rod composition to project beyond the rods perimeters to bear against the top surface of the channel member 22′.

While the construction and affixation of the cross bar rods and vertical rods are only shown in the modified channel member drawing of FIG. 4 it must be realized that such structure may be used equally well with the channel member 22 of FIG. 3.

While the present invention is shown to be of various pieces held together by sliding or threaded rods and lock nuts therefore making the unit collapsible, the parts may be welded or otherwise secured together as a single structure.

The invention and its attendant advantages will be understood from the foregoing description and it will be apparent that various changes may be made in the form, construction and arrangements of the parts without departing from the spirit and scope thereof or sacrificing its material advantages, the arrangements herein before described being merely by way of example. I do not wish to be restricted to the specific forms shown or uses mentioned, except as defined in the accompanying claims, wherein various portions have been separated for clarity of reading and not for emphasis.

I claim:

1. A fireplace newspaper holder to be positioned within a fireplace having a floor and adapted to receive a plurality of newspapers to be ignited, said holder comprising:

a base member having a pair of channel members with at least an outer face and a pair of parallel upper and lower faces extending between said outer face, and spacer cross bar members mounted through said outer face of said channel members forming a frame and said frame adapted to rest upon said floor;

a first row of a plurality of vertical rods maintained in said base member in spaced relationship one from the other;

a second row of a plurality of vertical rods maintained in said base member each in alignment with one of the plurality of vertical rods in said first row, wherein spaces are created therebetween to receive said newspapers in a folder vertical position resting upon said base; and the height of each of said vertical rods is sufficient to retain said folded newspapers in a generally vertical position, whereby said newspapers may be ignited to give off heat and esthetic visual effects.

2. A fireplace newspaper holder as defined in claim 1 wherein each of said upright spacer means exceeds at least one half the height of said folded newspapers between said co-planar top and bottom edges and said fold.

3. A newspaper holder as defined in claim 1 wherein:

said spaces between said rods of one row are irregular and not equadistant one from the other.

4. A fireplace newspaper holder as defined in claim 1 wherein:

said vertical rods each include portions that pass through said channel members and each rod includes stop means projecting from the perimeter of said rods to engage said top face of said channel members.

5. A fireplace newspaper holder as defined in claim 1 wherein each of said vertical rods include:

a threaded end portion adapted to be threaded through said channel member; and lock nuts on said threaded end portion adapted to engage said channel member and maintain said rods in a locked position.

6. A fireplace newspaper holder as defined in claim 1 wherein each of said spacer cross bar members include threaded ends which are threadably mounted through said channel members and each is provided with a lock nut to maintain said cross bar members to said channel members.

* * * * *